US005107772A

United States Patent [19]

Viens

[11] Patent Number: 5,107,772

[45] Date of Patent: Apr. 28, 1992

[54] RAIL BOGIE FOR TRANSPORTING SEMI-TRAILERS WITH VERTICALLY MOVABLE KING PIN ASSEMBLIES ON COMMON FRAME

[76] Inventor: Jacques Viens, 1486 Bellemare, Roxton Pond, Quebec, JOE 1ZO, Canada

[21] Appl. No.: 542,121

[22] Filed: Jun. 22, 1990

[51] Int. Cl.[5] ..... B61F 13/00

[52] U.S. Cl. ..... 105/159; 105/4.2; 410/57

[58] Field of Search ..... 105/3, 4.1, 4.2, 159, 105/72.2, 215.2; 410/45, 53, 56, 57

[56] References Cited

U.S. PATENT DOCUMENTS

| | | | |
|---|---|---|---|
| 2,036,535 | 4/1936 | Nelson | 105/4.1 X |
| 4,274,776 | 6/1981 | Paton | 410/57 |
| 4,416,571 | 11/1983 | Krause | 410/53 |
| 4,547,107 | 10/1985 | Krause | 410/58 |
| 4,669,391 | 6/1987 | Wicks | 105/4.3 |
| 4,685,399 | 8/1987 | Baker | 105/4.1 |
| 4,766,818 | 8/1988 | Wicks | 105/4.3 |
| 4,773,335 | 9/1988 | Smith | 105/4.3 |
| 4,981,082 | 1/1991 | Wicks | 105/4.1 |

OTHER PUBLICATIONS

Italians Join the Intermodal Race, Gazette International, Sep. 1987.

Return of the RoadRailer, J. J. Callari, Traffic Management, Sep. 1987.

*Primary Examiner*—Robert J. Oberleitner

*Assistant Examiner*—S. Joseph Morano

*Attorney, Agent, or Firm*—Edwin E. Greigg; Ronald E. Greigg

[57] ABSTRACT

A rail bogie for hooking with semi-trailers and the like road vehicles comprises a truck having a wheel-mounted chassis and a fifth-wheel frame above the chassis. Power jacks or inflatable balloons are mounted between this chassis and the frame for moving the latter vertically between a low and a high positions relative to the chassis. There is also provided a locking combination on the frame and on the chassis capable of holding the frame releasably locked to the chassis when the said frame has reached the high position aforesaid. The bogie also includes a horizontal fifth-wheel support mounted on the frame for pivotal movement about a vertical axis whereby to allow it to sway laterally and a fifth-wheel is mounted at the other end of the support. The bogie further includes an assembly automatically centering the first wheel on the frame when the latter reaches its high position.

26 Claims, 11 Drawing Sheets

RAIL BOGIE FOR TRANSPORTING SEMI-TRAILERS WITH VERTICALLY MOVABLE KING PIN ASSEMBLIES ON COMMON FRAME

This application is related to application Ser. No. 512,224 filed Apr. 20, 1990, which is a division of Ser. No 333,053 filed Apr. 4, 1989.

BACKGROUND OF THE INVENTION

1. Field of the Invention

The present invention relates to rail bogies for hooking with semi-trailers and the like road vehicles to form trains for riding on rails. It is of the type disclosed in my prior Canadian application No. 561,449 filed on Mar. 15, 1988.

2. Description of the prior art

In the said application, there is disclosed a twin-axle rail bogie over the wheeled truck of which is mounted, through an air spring suspension, a lift assembly supporting a platform having a pair of fifth-wheels for connection of the bogie with king pins of a pair semi-trailers so that the latter and the bogie together form part of a railway train. The platform lift assembly is wholly mechanical, being constituted by a plurality of combinations of coupled worms and worm-wheels of which the worm-wheels drive screws moving up and down to raise and lower the fifth-wheel platform.

In such an arrangement, the loads coming from the semi-trailers are constantly supported by the pneumatic suspension but only through this mechanical lift assembly. Consequently, the latter is permanently subjected to heavy stresses generated when the bogie is jolted. It follows that the lift assembly is prone to deteriorate rapidly because of its mechanical nature.

Known to the present Applicant are the following U.S. Pat. Nos., not pertinent to the present invention:

4,416,571
4,547,107
4,669,391
4,685,399
4,773,335
4,766,818

Thus U.S. Pat. Nos. 4,416,571 and 4,685,399 relate to rail bogies having a pair of fifth-wheels for connection with semi-trailers but mounted directly on the chassis of the bogie. In U.S. Pat. No. 4,547,107 each of the fifth-wheels each of the two fifth-wheels is individually lifted by means of a power jack. In such respects, these patents are not pertinent to the present invention. The remaining patents are even less pertinent, as will be seen from the description that follows.

SUMMARY OF THE INVENTION

An object of the invention is to avoid the drawback mentioned above by providing a rail bogie wherein the loads carried by the semi-trailers, during travel, are transmitted directly from a fifth-wheel frame to the chassis of the bogie and from there to a pneumatic suspension in such a manner as to avoid completely the lift assembly, hereinafter called frame moving means.

In accordance with the invention, once the king pins of the semi-trailers are connected with the fifth-wheels of the vertically moving frame, in low position of the latter, the said frame is raised to its high position of travel and there locked with the bogie truck chassis so as to be held, in travel position, completely independently of the frame moving means by-passing it.

Yet another object of the invention lies in the provision of a bogie of the above type wherein the lower one of the two fifth-wheels is mounted on a pivotable support which is thus allowed to sway laterally when the king pins of one of the semi-trailers is inserted into the said lower fifth-wheel.

Still another object is to provide a rail bogie which includes means for automatically centering the above low fifth-wheel and king pins as the frame reaches its high travel position.

More specifically, a rail bogie made according to the invention broadly comprises a truck having a chassis and railroad wheels mounted thereon, a fifth-wheel frame above the chassis, means between the chassis and frame for moving the frame vertically between a low and a high position relative to the chassis and means for holding the frame releasably locked to the chassis when it has reached the high position.

It also preferably comprises a horizontal fifth-wheel support on the frame, means mounting one end of the support on the frame for pivotal movement of the support about a vertical axis to allow swaying motion thereof, and a first fifth-wheel mounted at the other end of the support.

Still preferably, it further includes means for automatically centering the first fifth-wheel on the frame when the latter reaches its high position.

According to a preferred form, the fifth-wheel frame has a flat bottom and the releasable lock holding means comprises a lock carrier on the flat bottom and means for guiding the carrier during longitudinal translation thereof over the frame bottom, bolt and keeper means on the carrier, on the frame and on the chassis, constructed to hold and to lock the frame to the chassis when the frame has reached the high position; first means biassing the carrier into longitudinal translation in one direction to cause the bolt and keeper means to lock the frame to the chassis, and second means biassing the carrier into longitudinal translation in opposite direction to cause release of the frame from the chassis.

Other objects and features of the invention will become apparent from the description that follows of a preferred embodiment having reference to the appended drawings.

IN THE DRAWINGS

Figures 5A, 5B:
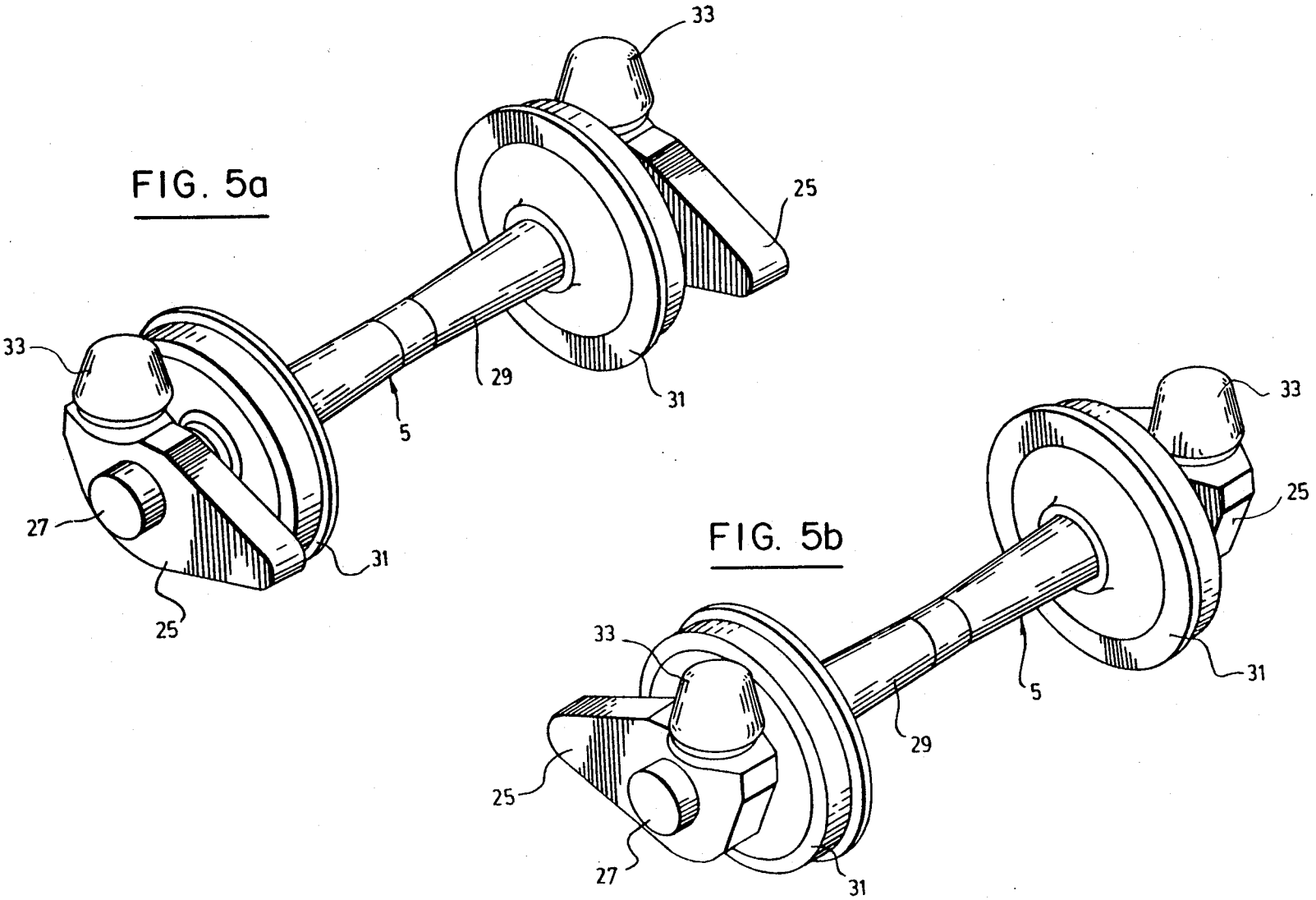
Figure 6:
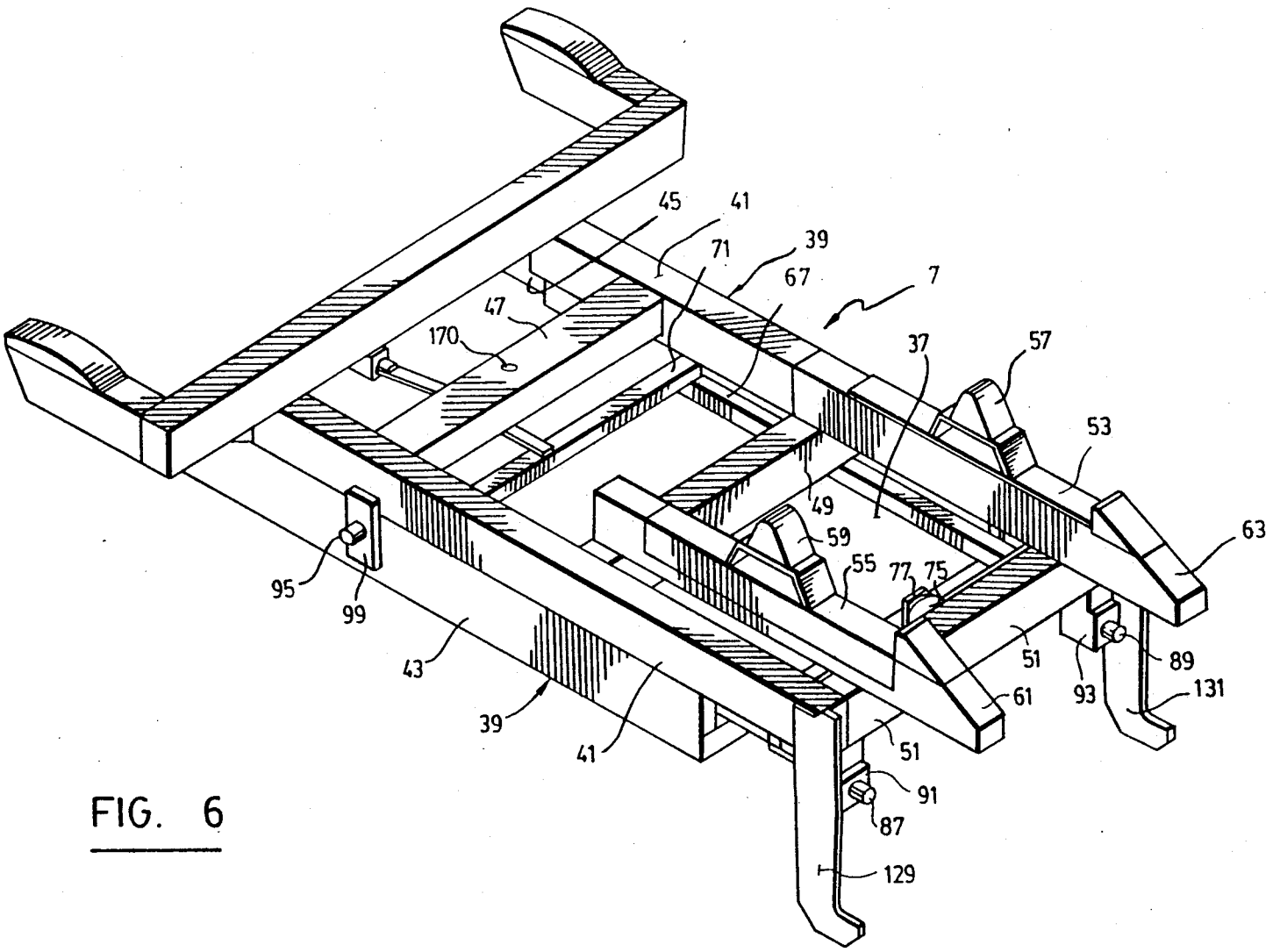
Figure 7:
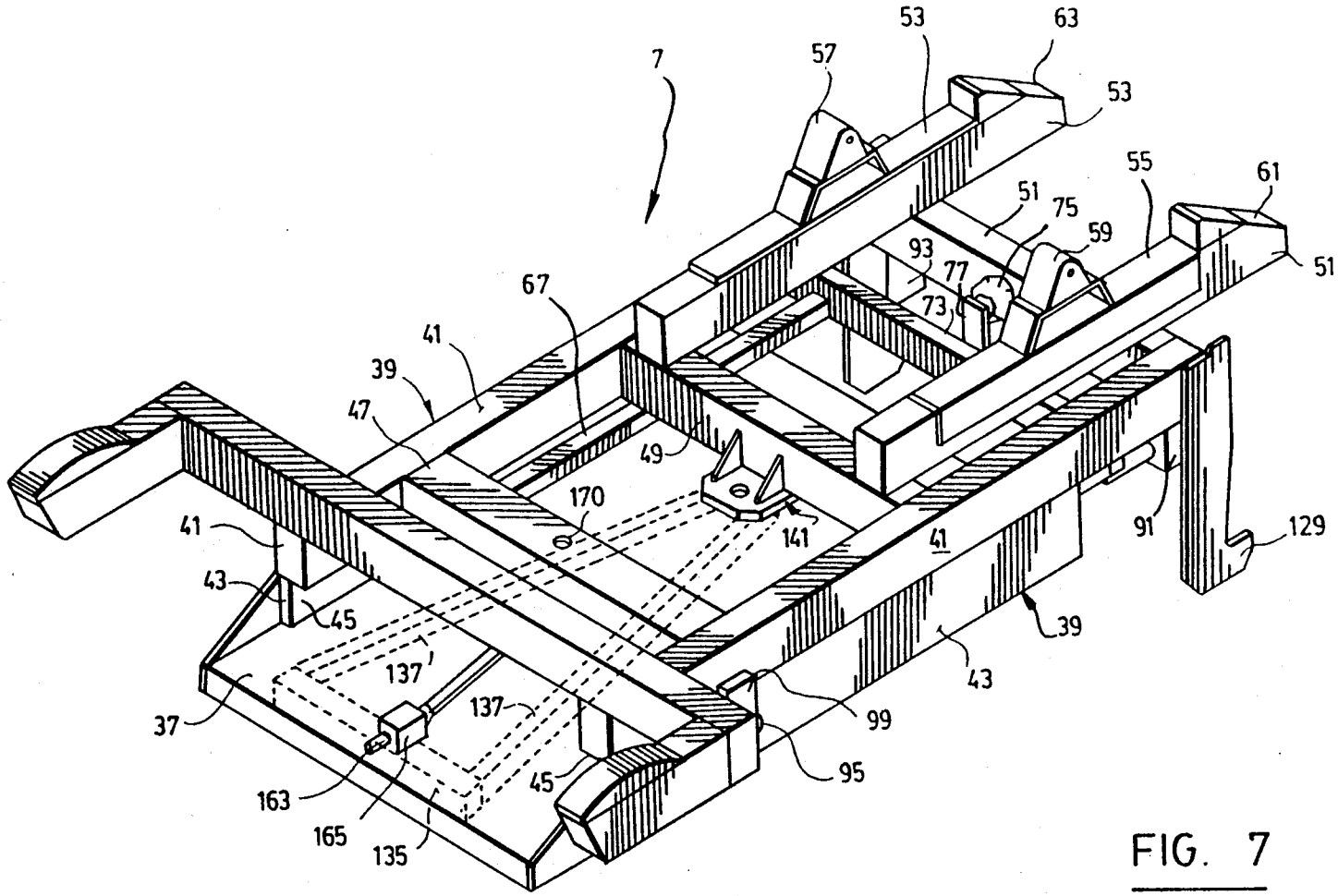
Figure 8:
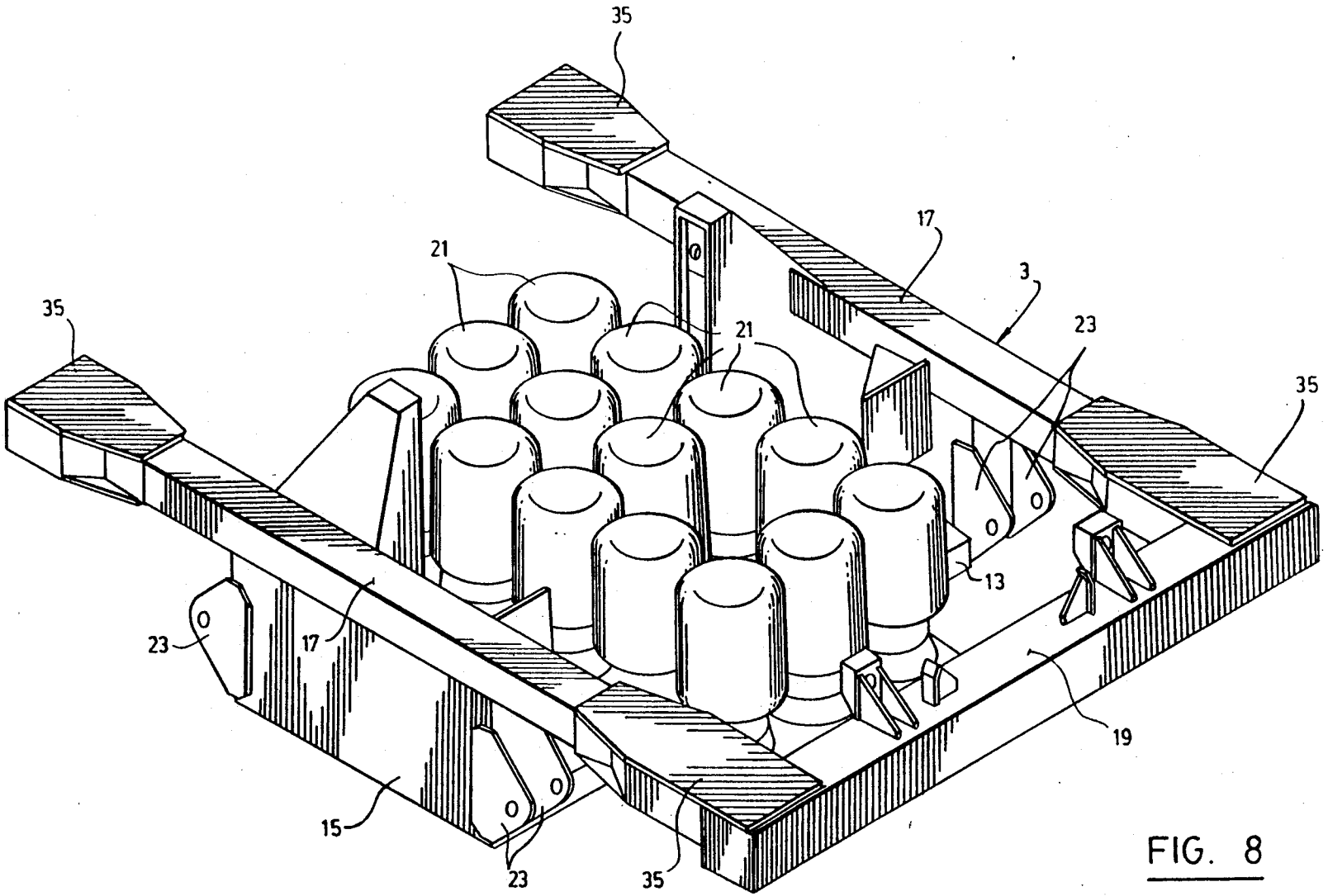
Figures 9, 9A:
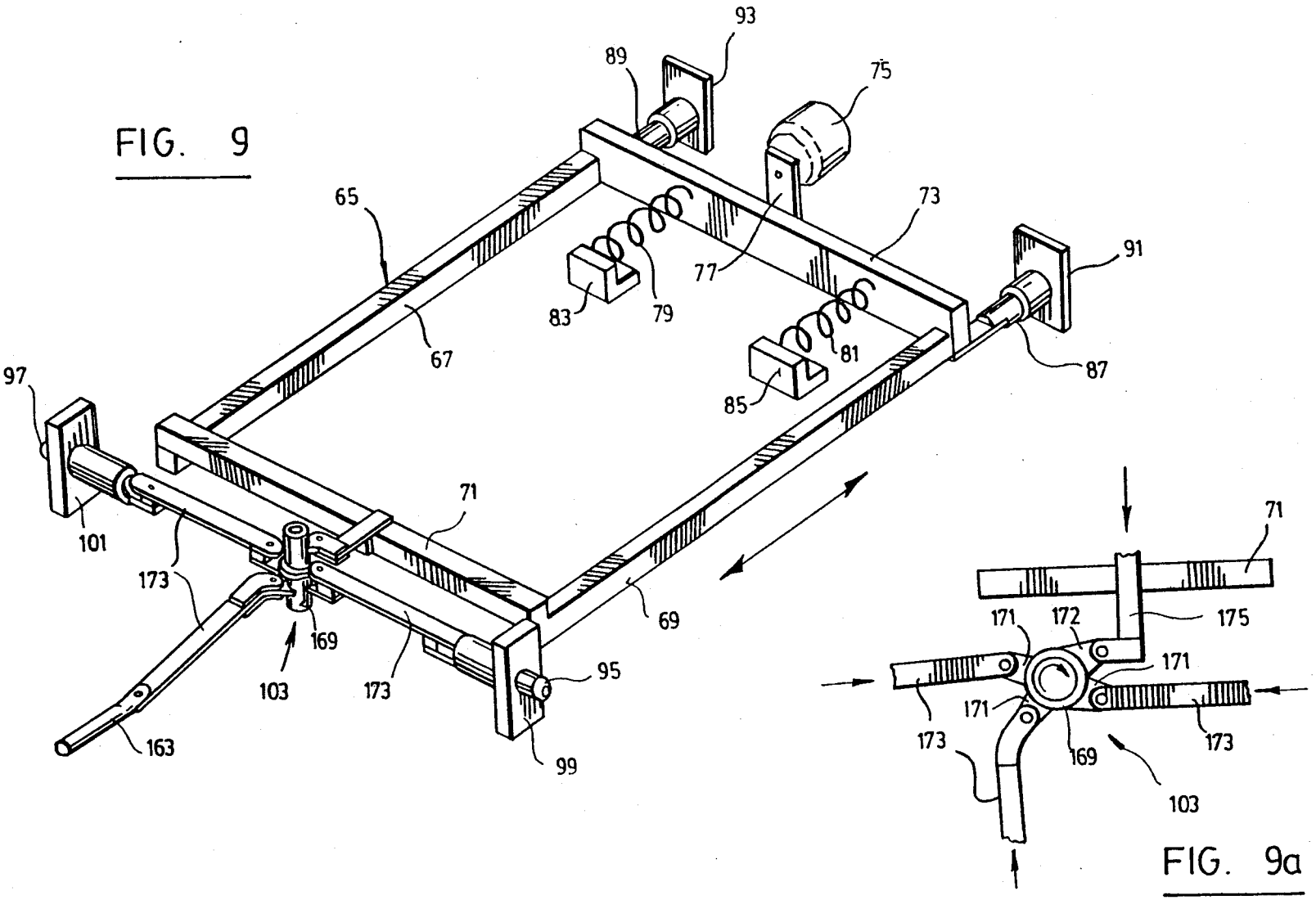
Figure 10:
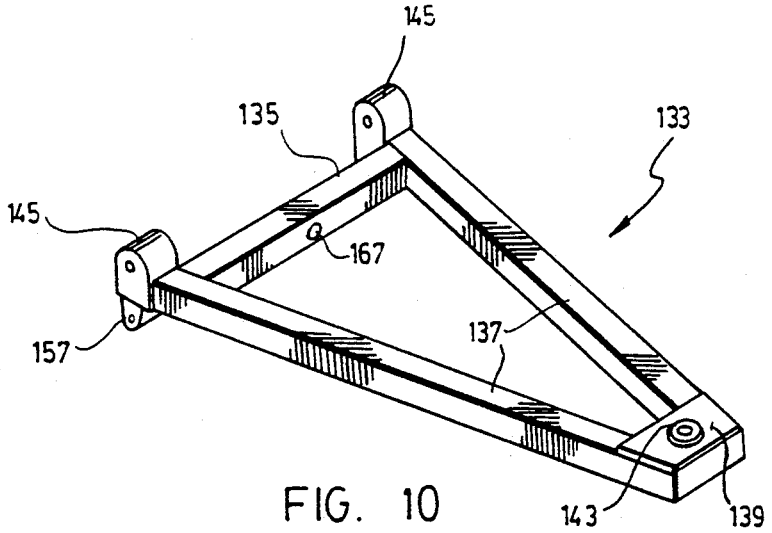
Figure 11:
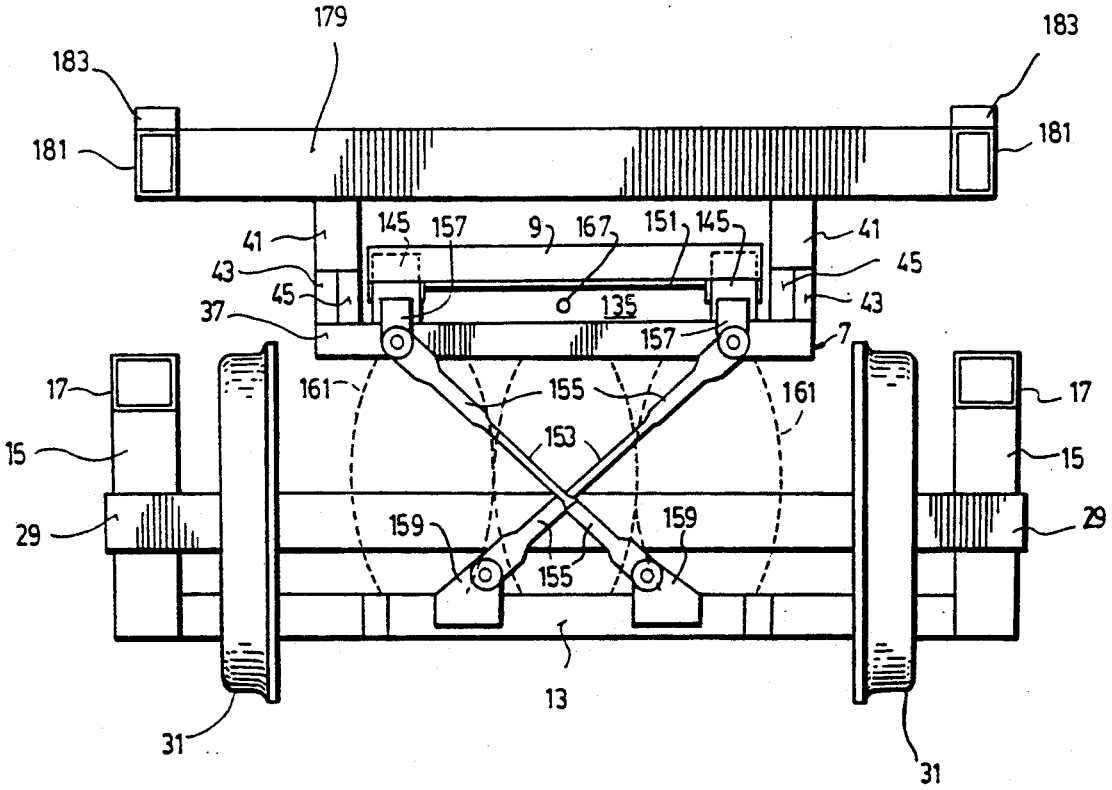

FIGS. 5*a* and 5*b* are perspective view of a pair of wheel assemblies with arms for mounting them on the truck chassis;

FIG. 6 is a perspective view of the vertically movable frame;

FIG. 7 is a view similar to FIG. 6, turned 180°;

FIG. 8 is a perspective view of the truck chassis equipped with frame moving means;

FIG. 9 is a perspective view of the releasable locking means for holding the frame in high position;

FIG. 9*a* being a top plan view of a detail;

FIG. 10 is a perspective view of the support for the lower one of the fifth-wheels;

FIG. 11 is a front end elevation view of the bogie; and

Figure 12:
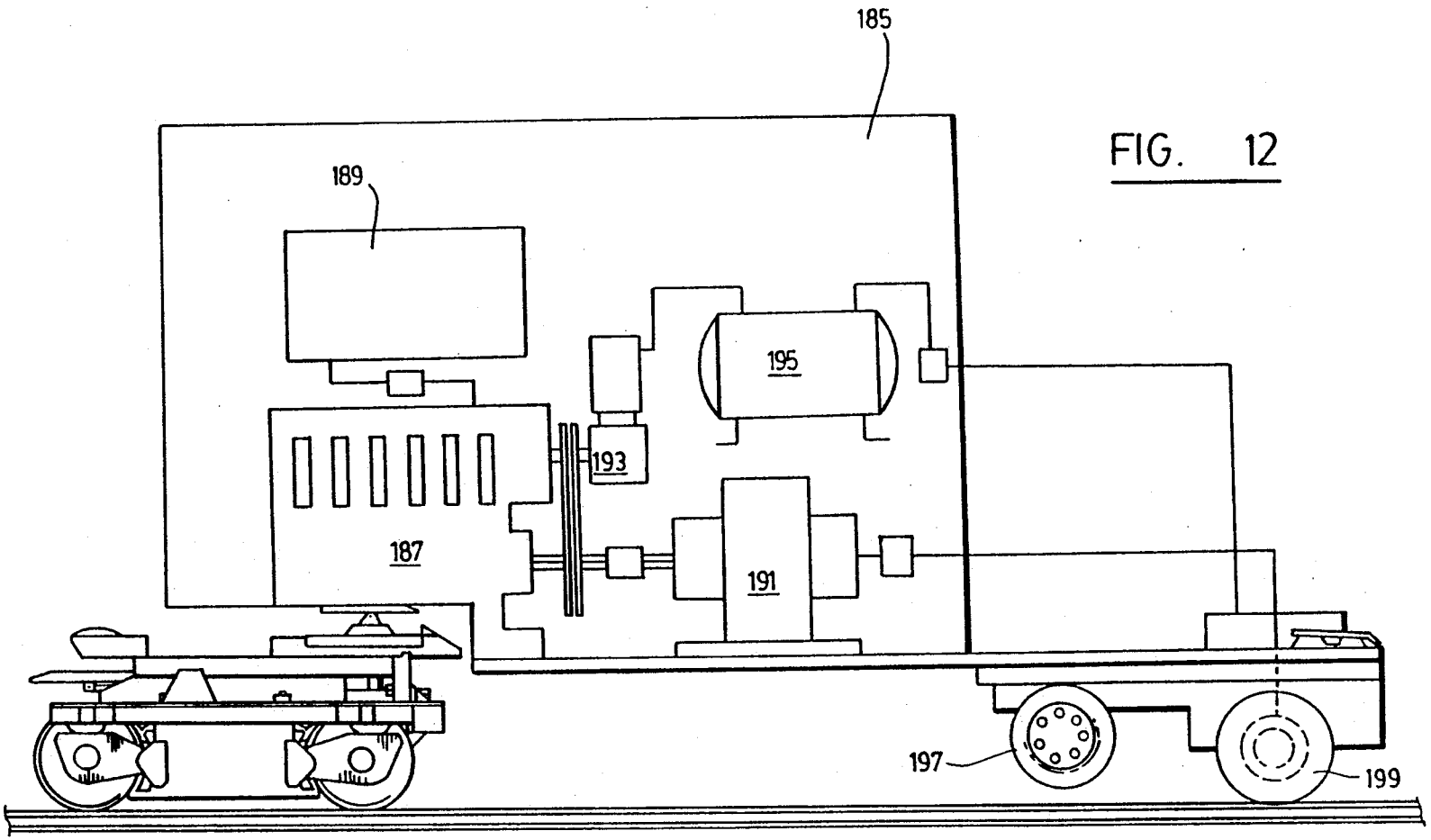

FIG. 12 is a side view of a train drive unit equipped, at the front, with a bogie made according to the invention.

DESCRIPTION OF THE PREFERRED EMBODIMENT

There is shown a twin-axle rail bogie 1, having a truck in the form of a chassis 3 (FIG. 3) mounted on a pair of wheel assemblies 5 (FIG. 5), and a fifth-wheel frame 7 (FIG. 6) located above the chassis. As said before, the bogie further comprises means between the chassis 3 and the frame 7, which serve for moving the frame, relative to the chassis, between the low position of FIG. 1 and the high position of FIG. 2, and other means which serve to hold the frame 7 releasably locked to the chassis, such means being described in detail hereinafter. On the vertically movable frame 7 are two standard fifth-wheels 9, 11. As is known, king pins of semi-trailers to be hooked with the bogie 1 are made to interlock, in low position of the frame 7, with the fifth-wheels 9, 11. The frame is thereafter raised to its high riding position of the bogie.

For convenience in the description that follows, the leftward end of the bogie 1, as shown, is said to be the front end and the rightward end, the rear end.

Figure 4:
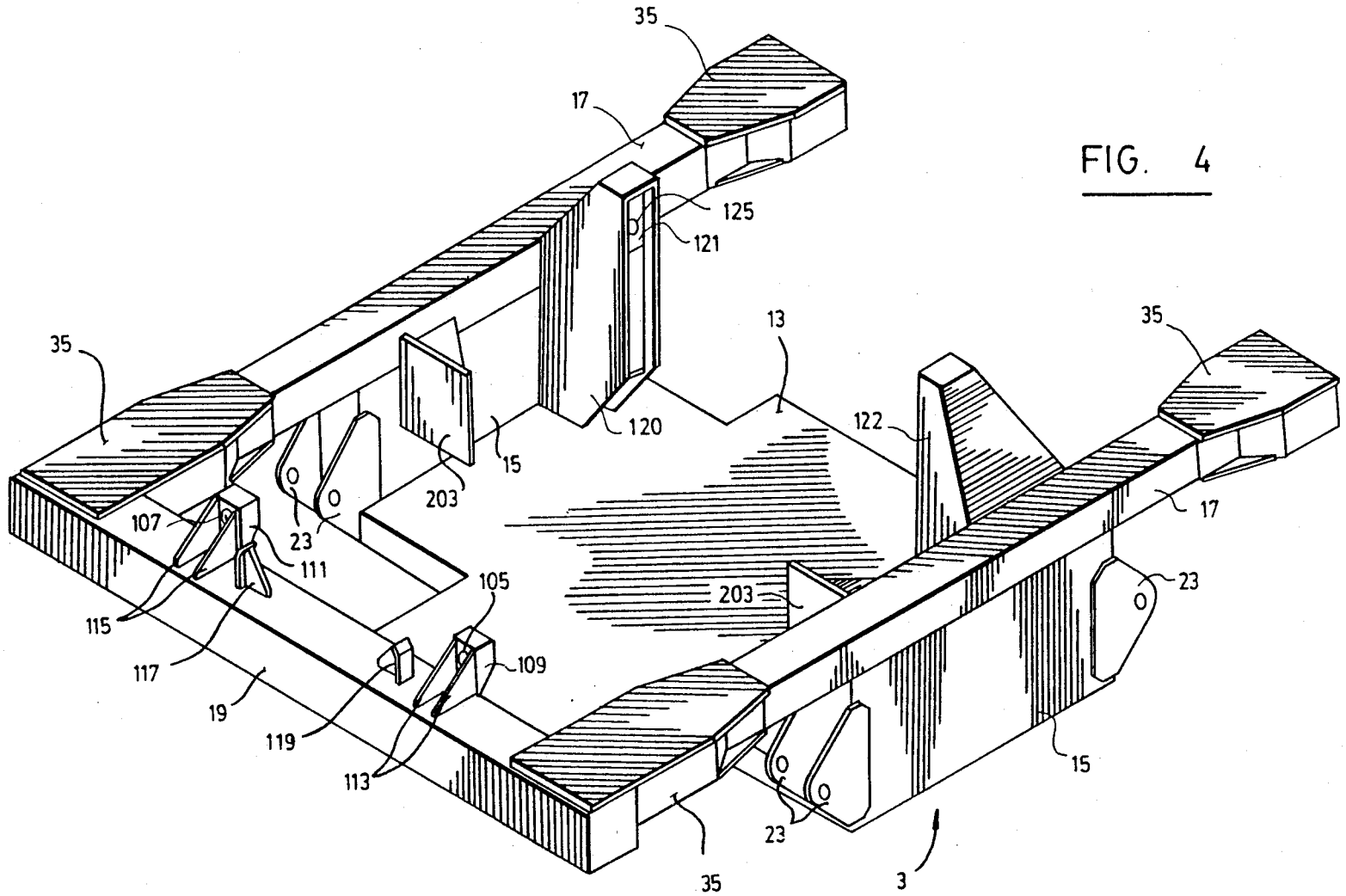
FIG. 4 is a perspective view of the chassis of the bogie truck.

Referring more particularly to FIGS. 4, 5 and 8, the chassis 3 is seen to comprise a cross-shaped base platform 13 with upright sidewall structures 15 solid with and projecting down from longitudinal beams 17 intermediate their ends. The beams 17 are interconnected, at the bogie rear end, by a transverse strut 19. As illustrated in FIG. 8, a series of fluid-operated power jacks 21 are fixed to the platform 13 and serve as means to raise and lower the frame 7 which is fixedly mounted over them. These jacks may be hydraulic or penumatic.

At each end of each sidewall structure 15 is a pair of bracket plates 23 to which are mounted one end of lever arms 25 (FIGS. 1 and 5) such that the latter may swing about a first pair of axes extending transverse to the beams 17 and parallel to the cross strut 19. The other ends of the lever arms 25 are provided with journal boxes 27 receiving the ends of the axles 29 of the wheel assemblies 5, on which axle 29 wheels 31 are mounted for rotation about a second pair of axes parallel to the first ones. An air-spring suspension 33 is mounted at the end of each lever 25 above the journal box 27. Suspensions 33 are received in appropriate housing members 35 formed at the ends of the longitudinal beams 17.

As perhaps best illustrated in FIGS. 6 and 7, the vertically displaceable frame 7 carrying the fifth-wheels 9, 11, has a flat plate bottom 37 and a pair of side members 39 each made up of a top part 41 and a bottom part 43, the top one 41 overhanging the bottom one 43 so as to define a rabbet 45 between them for a purpose to be determined hereinafter. The top parts 41 are interconnected by three cross-braces 47, 49, 51 having the same depth as the top parts 41, that is terminating at the same level as the bottom face of the top parts 41. A birth structure for the rear fifth-wheel 11 (FIG. 1) is fast with the cross-braces 49, 51, being made up of two stringers 53, 55, (FIGS. 6 and 7) over which are secured two pillow-blocks 57, 59 serving to receive the rocker pins or axle of the bed-plate of the fifth-wheel 11, in known fashion. The forward ends of the stringers 53, 55, terminate into ramps 61, 63, for easing the front end of a semi-trailer onto the fifth-wheel 11.

As said earlier, one of the main features of the invention, is the presence of releasable locking means capable of firmly holding the fifth-wheel frame 7 in its high position against the chassis 3 so that the load carried by the fifth-wheels 9, 11, will be transferred directly to the suspension air springs 33 (FIG. 5) without affecting its frame moving jacks 21 (FIG. 8).

The releasable-lock holding means aforesaid is shown in FIG. 9. It comprises a lock carrier 65 in the form of a rectangular structure having two square side bars 67, 69, interconnected by a front square bar 71 and a rear rectangular bar 73. It will be noted that the front bar 71 is fast with the top of the side bars 67, 69, and that the rear bar 73 extends beyond the top of the side bars 67, 69, a distance equal to the height of the front bar 71. The carrier 65 is thus so dimensioned that when placed over the flat bottom 37 of the frame 7 (FIGS. 1, 2, 6, 7) its side bars 67, 69, are lodged in the rabbets 45 of the side members 39 and the cumulating heights of the side and front bars 67, 69, 71, along with the full height of the rear bar 73 are equal to the height of the rabbets 45 (FIG. 7) so as to allow the carrier to slide smoothly and easily over the flat bottom 37 and be guided by the rabbets 45. The carrier 65 may be moved forwardly by an inflatable bag or balloon 75 of which one end is fixed to the frame rear cross-braces 51 (FIGS. 6 and 7) and to a vertical short plate 77 rising from the rear bar 73 of the carrier 65.

It is moved back rearwardly, when the bag 75 is deflated, by a pair of return springs 79, 81 located between a pair of brackets 83, 85, (fixed to the flat bottom 37 of the frame 7) and the rear bar 73 of the carrier 65. Thus the carrier 65 is able to move in both lengthwise directions of the frame 7, as shown by the arrow in FIG. 9.

Bolt and keeper means are provided on the carrier 65, on the frame 7 and on the chassis 3 to hold and lock the frame to the chassis when the frame has reached its high position of bogie travel. Such means are detailed as follows.

Two rear lock bolts 87, 89, (FIG. 9) are pivotally connected at one end to the rear bar 73 of the carrier 65 and fit snugly through bores of corresponding guide blocks 91, 93, solid with and depending from the rear cross-brace 51 (FIG. 6) of the frame 7. The blocks may be formed of a thick plate and of a guide sleeve, as shown in FIG. 9.

Two further lock bolts 95, 97, are provided at the front of the carrier 65 for transverse motion. They are made to fit into through bores of guide blocks 99, 101, made solid with the frame side members 39, as best shown in FIG. 6 for one of them. Lateral displacement of the lock bolts 95, 97, is by means of a bolt driving mechanism 103 described further on.

In high position of the lock carrier 65, the rearward lock bolts 87, 89, slide through the guide blocks 91, 93, and then through sockets 105, 107, of a pair of keeper members 109, 111, (FIGS. 2 and 4) fixed to the strut 19 of the chassis 3 by means of pairs of triangular plates 113, 115.

Figure 1:
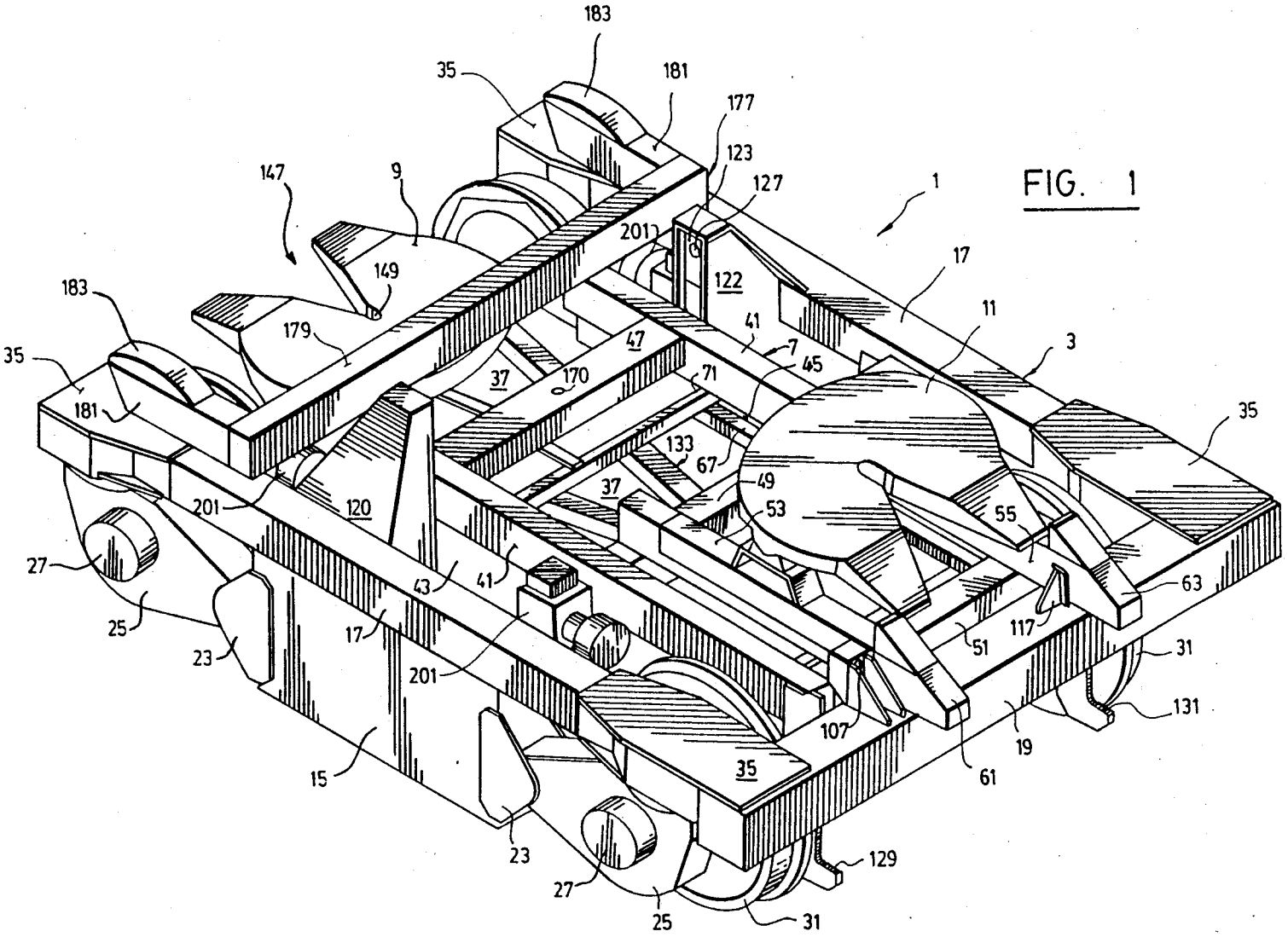
FIG. 1 is a perspective view of a rail bogie made according to the teaching of the invention with the fifth-wheel frame shown in low position, FIG. 2 being the same view but with the fifth-wheel frame shown in high position.

Post structures 117, 119, rising from the strut 19 next to the bracket plates 113, serve to guide and hold the ramps 61, 63, in low position of the rear fifth-wheel 11, as seen in FIG. 1.

Referring again to FIGS. 1 and 4, it is seen that columns 120, 122, are provided on the sidewall structures 15 and beams 17, within the chassis 3. Their front faces are in sliding contact with the top parts 41 of the frame side members 39 so as to guide the frame 7 during its vertical movement. They also contain keeper members 121, 123, defining sockets 125, 127 for receiving the lateral lock bolts 95, 97 (FIG. 9) when the frame 7 is in its high position.

To ensure proper alignment of the lock bolts 87, 89, 95, 97, with their respective sockets 105, 107, 125, 127, the frame is provided with stopping means in the form of a pair of L-shaped hooks 129, 131, projecting down from the side member top parts 41. The lower horizontal arms of the hooks serve as locking branches for the frame as they butt against the lower faces of the strut 19 of the chassis 3, thereby preventing the frame from overshooting its high position.

Figure 2:
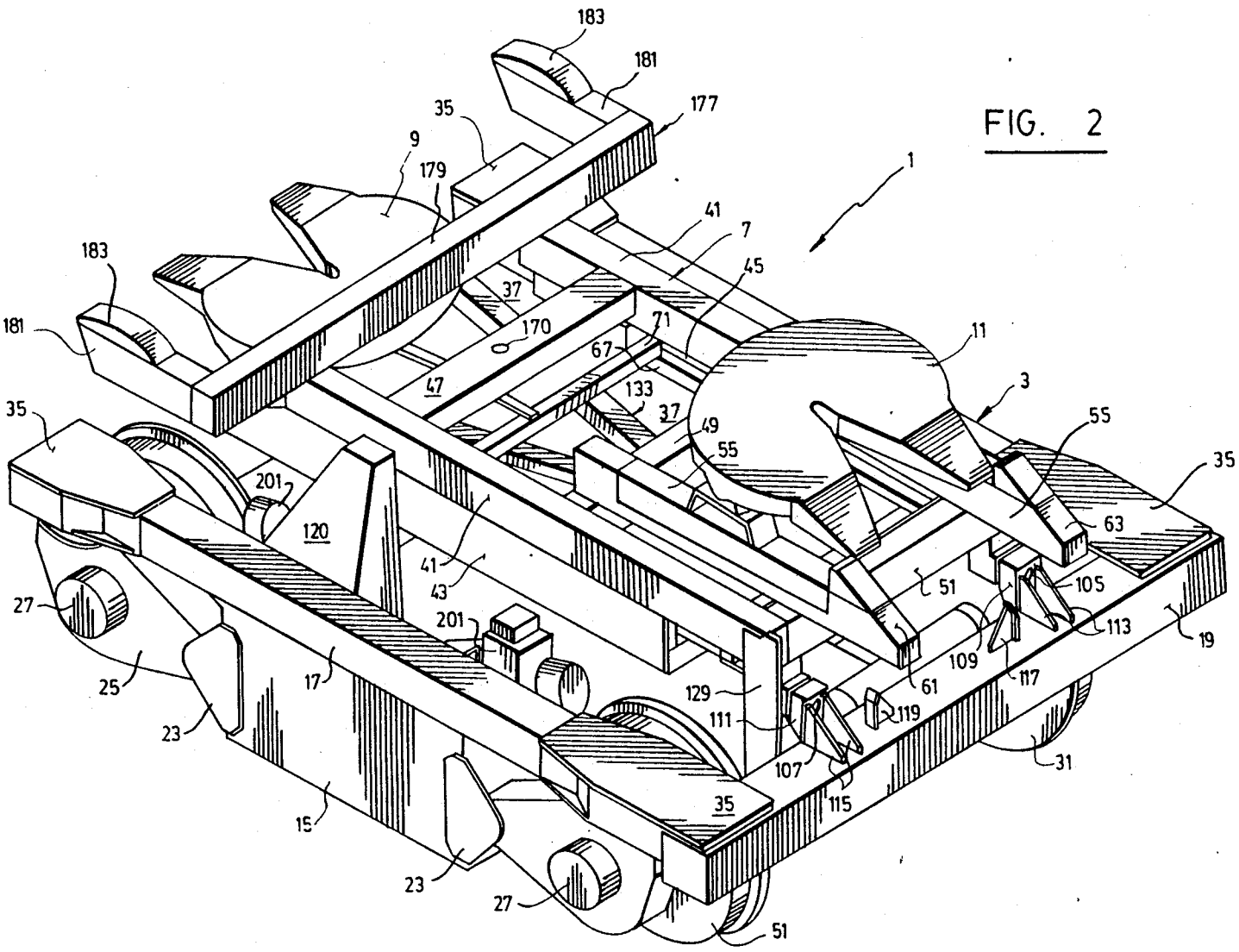
Figure 3:
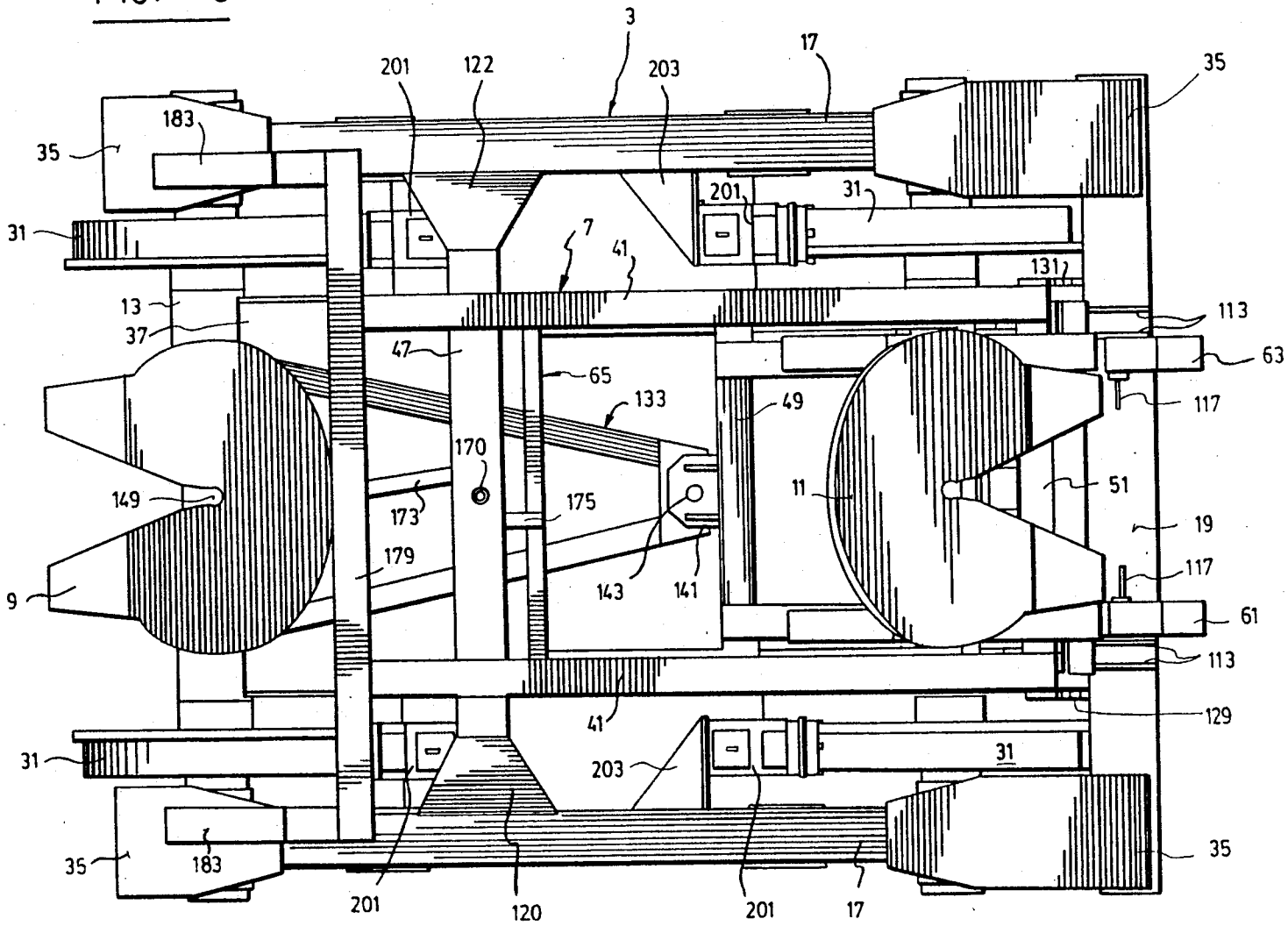
FIG. 3 is a top plan view of the bogie.

According to another feature of the invention, the shown embodiment includes a horizontal support 133 (FIG. 10) for the front fifth-wheel 9. It has the shape of an isoceles triangle having a base member 135, two side members 137 and an apex connector 139. It lies flatly over the the flat bottom 37 of the frame 7 with its side members 137 extending beneath the front cross-bar 71 of the lock carrier 65 as shown in FIGS. 1 and 2. The apex connector 139 fits between the bottom 37 and a pivot bracket 141 (see FIG. 7) secured to the central cross brace 49 of the movable frame 7. The bottom 37, the bracket 141 and the apex connector 139 are formed with appropriate coaxial holes into which fits a pivot pin 143. In this manner, the support 133 is allowed lateral swaying motion about the vertical axis of the pivot pin 143. The first fifth-wheel 9 is mounted on pillow blocks 145, in the usual manner, by rocker pins or a rocker axle 151 (FIG. 11) fitting into the pillow blocks, for limited rocking motion about a transverse axis. The pillow blocks 145 project forwardly of the base member 135. Swaying of the support 133 allows, where applicable, easier entry of the front king-pin of a semi-trailer into the V opening 147 (FIG. 1) of the front fifth-wheel 9 whereby to reach the locking aperture 149, when the movable frame is in its low coupling position.

Where the support 133 and its fifth-wheel 9 have swayed slightly during the coupling procedure, as aforesaid, it is preferred that the frame 7 be provided with means for automatically and gradually centering the fifth-wheel 9 as it is raised so that then in high position, the king pin and fifth-wheel be aligned with the centre line of the bogie. Additionally, the fifth-wheel 9 should be locked in that position, during travel.

For that purpose and referring to FIG. 11, there is provided a pair of cable connectors of equal length crossing one another and each being formed of a flexible cable 153 provided at its ends with turnbuckles 155 of which one is pivotally mounted to a bracket 157 depending from the base pillow block 145 (FIG. 10) and the other to a bracket 159 fast with the platform 13 of the chassis 3. It will be noted that both the pillow blocks 145 and their dependant brackets 157 project forwardly of the base member 135 and the brackets 157 forwardly of the bottom 37 of the frame 7 in order for the cable connectors to be secured to the chassis. If, when the movable frame 7 is in low coupling position, the support 133 and the fifth-wheel 9 are shifted laterally, they will straighten up and center themselves automatically by the action of the cable connectors as the frame rises to its high position. It will be seen, in FIG. 11, that the frame 7 is lifted by means of inflatable air springs 161 that can be used as alternatives to the power jacks 21 of FIG. 8.

In order to lock the support 133 in the longitudinal central position of the frame 7, there is provided an additional lock bolt 163, FIGS. 7 and 9, which slides first through a hole of a further guide block 165 solid with the flat bottom 37 and then through a keeper 167 at the center of the base member 135 which stands forwardly of the guide block 165, as shown in broken lines in FIG. 7. The lock bolt 163, along with the laterally displaceable lock bolts 95, 97, are driven by the previously mentioned mechanism 103 detailed in FIGS. 9 and 9*a*.

This mechanism 103 comprises a central post 169 journaling, at the top in an appropriate central bearing hole 170 (FIG. 7) at the center of the frame cross-bar 47 and, at the bottom, in a further and coaxial bearing hole (not shown) in the flat bottom 37 of the frame. Solid with this post 169 are three radial ears 171 pivoted to three arms 173 which in turn are pivoted to the frame inward ends of the lock bolts 95, 97 and 163, in the manner shown in FIGS. 9 and 9*a*. A fourth ear 172, formed with an elongated radial slot (not shown), is pivoted to one end of a L-shaped operating lever 175 of which the other end is fixed to the front cross-bar 71 of the lock carrier 65.

In FIGS. 9 and 9*a*, the frame 7 is in high position and the lock bolts 87, 89, 95, 97 and 163, are housed in the sockets of their respective keeper members 109, 111, 121, 123, (FIGS. 1 and 7) and the socket 167 of the base member 135, acting as a keeper member. When it is desired to unlock the frame 7 from the chassis 3, the bag 75 (FIG. 9) is inflated and the lock carrier 65 pushed forward. The rear lock pins 87, 89 are of course drawn out of their keeper members 109, 111, (FIG. 4) while the L-shaped lever 175 on the front cross-bar 71 rotates the post 169 clockwise, as shown in FIG. 9*a*, causing withdrawal of the lock pins 95, 97 and 163 from their respective keeper members 121, 123 and 135, thereby unlocking the frame 7 and allowing it to be moved down to low position, support 133 being also freed.

It is mentioned, at this time, that the front fifth-wheel 9 stands at a lower level than the rear fifth-wheel 11 (see FIG. 12), the lower fifth-wheel 9 engaging beneath the rear end of a semi-trailer while the front fifth-wheel 11 engages beneath the front end of another semi-trailer.

In order to assist the fifth-wheel 9 in the coupling procedure, the frame 7 should preferably be provided with an assisting lifting fork 177 (FIGS. 1 and 2) having a base member 179, fixed to the side member parts 41 of the frame 7, and a pair of side prong members 181 with padded free ends 183.

FIG. 12 shows the rear end of a bogie 1, as above described, coupled to the front end of a diesel engine semi-trailer 185 of which the rear end is permanently secured to the front end of a bogie 186 of special but known construction. Semi-trailer 185 comprises a diesel engine 187, with a fuel tank 189, operating an electric generator 191 and an air compressor 193 pressurizing air in a tank 195, the air serving to actuate the brakes of the wheels 197, 199 of the known bogie. The latter wheels are driven by electric motors fed from the generator 191.

FIGS. 1 and 2, illustrate air compressors 201 for actuating the brakes of the wheels 31 of the assemblies 5. These compressors are mounted on special brackets 203 (FIG. 4) of the chassis sidewall structures 15 and on the columns 120, 122.

What is claimed is:

1. A rail bogie for hooking with semi-trailers to form trains for riding on rails, said bogie comprising:

a truck having a chassis (3) mounted on a pair of railroad wheel assemblies;

a frame (7) located above said chassis, said frame (7) being vertically movable with respect to said chassis;

first (9) and second (11) fifth-wheels mounted on said frame (7), said first and second fifth-wheels being oppositely oriented and vertically movable in unison together with said frame (7);

first means (21) between said chassis (3) and said frame (7) for moving said frame vertically between a low position and a high position relative to said chassis (3); and second means (120, 122) on said chassis (3) to guide said frame (7) during movement thereof between said high and low positions;

third means for holding said frame (7) releasably locked to said chassis (3) when said frame (7) has reached said high position.

2. A rail bogie as claimed in claim 1, further comprising:

a support (133) extending horizontally on said frame, said support having a pair of opposite ends;

fourth means (141) for mounting one end of said support (133) on said frame (7) for pivotal movement of said support about a vertical axis to allow swaying motion thereof; and wherein said first fifth-wheel (9) is mounted at another end of said support (133) opposite said one end.

3. A rail bogie as claimed in claim 2, including fifth means (153) for automatically centering said first fifth-wheel (9) on said frame (7) when said frame (7) reaches said high position.

4. A rail bogie as claimed in claim 1, wherein said releasable lock holding means comprise bolt and keeper means on said frame (7) and said chassis (3) and means for actuating said bolt and keeper means so as to cause said bolt and keeper means to releasably lock said frame to said chassis when said frame has reached said high position.

5. A rail bogie as claimed in claim 4, further comprising stopping means for arresting said frame when said frame has reached said high position.

6. A rail bogie as claimed in claim 5, wherein said chassis (3) comprises:

a pair of parallel longitudinal beams (17) each having a sidewall structure (15) depending therefrom;

lever arms (25), and means (23) for mounting one end of each of said arms at one end of said sidewall structures for swinging motion about a first pair of axes transverse to said beams;

said pair of railroad-wheel assemblies (5), each assembly including an axle (29);

journal means (27) mounted the ends of said axles on said lever arms (25) for rotation about a pair of second axes transverse to said beams and parallel to said first axes; and pneumatic suspension means (33, 35) at another end of each of said swing arms (25) opposite said one end, and on the ends of said beams (17).

7. A rail bogie as claimed in claim 5, wherein said chassis comprises a platform beneath said flat bottom and said frame moving means comprises pressure-fluid operated power jacks (21).

8. A rail bogie as claimed in claim 5, wherein said chassis comprises a platform beneath said flat bottom and said frame moving means comprise inflatable air balloons (161).

9. A rail bogie as claimed in claim 5, further comprising:

an assisting lifting fork (177) rigidly mounted on said frame (7), said assisting lifting fork (177) having a pair of side print members (181) with padded free ends (183) extending on both sides of one (9) of said fifth-wheels.

10. A rail bogie for hooking with semi-trailers to form trains for riding on rails, said rail bogie comprising:

a truck having a chassis (3) mounted on railroad wheels (31);

a frame (7) located above said chassis, said frame being vertically movable with respect to said chassis;

a first (9) and second (11) fifth-wheels mounted on said frame, said first and second fifth-wheels being oppositely oriented;

first means (21) between said chassis (3) and said frame (7) for moving said frame vertically between a low position and a high position (FIGS. 1, 2) relative to said chassis (3); and third means for holding said frame (7) releasably locked to said chassis (3) when said frame (7) has reached said high position;

wherein said frame (7) has a flat bottom (37) and said releasable lock holding means comprise:

a carrier (65) on said flat bottom and sixth means (45, FIG. 7) for guiding said carrier during longitudinal, translation thereof over said flat bottom;

bolt and keeper means on said carrier (65), on said frame (7) and on said chassis (3), constructed to hold and to lock said frame (7) to said chassis (3) when said frame has reached said high position;

first biassing means (83, 85) for biassing said carrier into longitudinal translation in one direction to cause said bolt and keeper means to lock said frame to said chassis; and second biassing means (75) for biassing said carrier into longitudinal translation in an opposite direction to said one direction to cause release of said frame from said chassis.

11. A rail bogie as claimed in claim 10, wherein said bolt and keeper means comprise:

locking bolts (87, 89, 95, 97, 163) on said carrier;

guide blocks (91, 93, 99, 101, 165) on said frame defining through bores into which said locking bolts slide; and keeper members (109, 111, 121, 123) on said chassis defining sockets located so as to receive relevant ones of said bolts (91, 93, 99, 101) when said frame is in said high position.

12. A rail bogie as claimed in claim 11, further comprising:

a support (133) extending horizontally on said flat bottom (37);

fourth means (141) mounting one end of said support on said flat bottom for pivotal movement of said support about a vertical axis, located centrally transversely of said frame, to allow lateral swaying motion thereof;

a base member (135) at another end of said support (133) opposite said one end, extending transversely of said frame, said base member being formed with a through bore (167) located at the lengthwise center thereof;

wherein one of said guide blocks (165) is solid with said flat bottom (37) at the transverse center thereof;

wherein one of said locking bolts (163) slidably fits into the bore of said one guide block (165);

wherein said first fifth-wheel (9) is mounted on said support (133); and constructed so that, in said high position of said frame and upon longitudinal translation of said carrier in said one direction, said one bolt (163) fits into said through bore (167) of said base member (135) to prevent said lateral swaying of said first fifth-wheel.

13. A bogie as claimed in claim 12, including means (153, 155) for automatically centering said support and said first fifth-wheel thereon on said frame as said frame moves to said high position.

14. A rail bogie as claimed in claim 12, wherein:

said carrier is a rectangular structure having side bars (67, 69) resting over said flat bottom (37), and front (71) and rear (73) cross-bars interconnecting said side bars;

two further bolts (87, 89) of said locking bolts project from said rear cross-bar (73) for translation thereof as said carrier (65) is displaced;

a bolt driving mechanism (103) is connected to said front cross-bar (71), said bolt driving mechanism (103) being actuated by said front cross-bar (71) as said carrier (65) is moved into said longitudinal translation; and two additional bolts (95, 97) of said locking bolts are operatively connected to said driving mechanism for movement thereof parallel to said front cross-bar (71).

15. A rail bogie as claimed in claim 14, wherein four further blocks of said guide blocks (91, 93, 99, 101) are provided on said frame (7) and located thereon so as to receive said further bolts and additional bolts (87, 89, 95, 97) respectively.

16. A bogie as claimed in claim 15, wherein said one locking bolt (163) is operatively connected to said driving mechanism (103) to be moved thereby in and out of said one guide block (165) as said lock carrier (65) is moved into said longitudinal translation.

17. A bogie as claimed in claim 16, including means (153, 155) for automatically centering said support and said first fifth-wheel thereon on said frame as said frame moves to said high position.

18. A bogie as claimed in claim 16, wherein said chassis (3) comprises a platform (13) and columns (120, 122) above said platform on either side thereof, said columns being in sliding contact with said frame (7) to guide said frame during movement thereof between said high and low positions.

19. A rail bogie as claimed in claim 18, wherein said chassis (3) has a rear and further comprises a rear transverse strut (19) and said keeper members (109, 111, 121, 123) are provided on said columns and on said rear transverse strut to cooperate with said locking bolts, respectively, to hold and lock said frame in said high position.

20. A rail bogie as claimed in claim 19, wherein said first biassing means (75) are provided between said rear cross-bar (73) of said rectangular structure and said rear transverse strut (19), and said second biassing means (79, 81) are provided between said rear cross-bar (73) and said flat bottom (37) within said rectangular structure.

21. A rail bogie as claimed in claim 19, including stopping means for arresting said frame (7) when said frame has reached said high position, said stopping means comprising L-shaped hooks (129, 131) depending on said frame (7) at the rear end thereof, said hooks including horizontal locking branches engageable with and beneath said rear transverse strut (19) to prevent said frame from overshooting said high position.

22. A rail bogie as claimed in claim 12, wherein said frame (7) comprises a birth structure (53, 55, 59) located above said flat bottom and at one end thereof opposite said first fifth-wheel;

wherein said second fifth-wheel (11) is mounted on said birth structure;

said birth structure being constructed for said second fifth-wheel (11) to be positioned at a higher lever than said first fifth-wheel (9).

23. A rail bogie as claimed in claim 10, wherein:

said carrier has a rear end and said chassis has a rear transverse strut (19) facing said rear end; and stopping means are provided for arresting said frame (7) when it has reached said high position, said stopping means comprising L-shaped hooks (129, 131) depending on said frame (7) at the rear end thereof, said hooks including horizontal locking branches engageable with and beneath said rear transverse strut (19) to prevent said frame from overshooting said high position.

24. A rail bogie as claimed in claim 10, wherein said chassis comprises a platform beneath said flat bottom and said frame moving means comprise pressure-fluid operated power jacks (21).

25. A rail bogie as claimed in claim 10, wherein said chassis comprises a platform beneath said flat bottom and said frame moving means comprise inflatable air balloons (161).

26. A rail bogie as claimed in claim 10, wherein said chassis (3) comprises:

a pair of parallel longitudinal beams (17) each having a sidewall structure (15) depending therefrom;

lever arms (25), and means (23) for mounting one end of each of said arms at one end of said sidewall structures for swinging motion about a first pair of axes transverse to said beams;

a pair of railroad-wheel assemblies (5), each assembly including an axle (29);

journal means (27) mounting the ends of said axles on said lever arms (25) for rotation about a pair of second axes transverse to said beams and parallel to said first axes; and pneumatic suspension means (33, 35) at another end of each of said swing arms (25) opposite said one end, and on the ends of said beams (17).

* * * * *